US005417351A

United States Patent [19]

Grosz

[11] Patent Number: 5,417,351

[45] Date of Patent: May 23, 1995

[54] GARMENT FOLDING AID

[76] Inventor: Denis Grosz, 6424 Pageantry St., Long Beach, Calif. 90808-4048

[21] Appl. No.: 136,533

[22] Filed: Oct. 14, 1993

[51] Int. Cl.[6] ..... A41H 33/00

[52] U.S. Cl. ..... 223/37; 223/38

[58] Field of Search ..... 223/37, 38, 39, 42

[56] References Cited

U.S. PATENT DOCUMENTS 3,111,246 11/1963 Lee ..... 223/37
3,181,747 5/1965 Lucius et al. ..... 223/37
3,391,839 7/1968 Gwinn et al. ..... 223/37
3,419,199 12/1968 Lonitzo ..... 223/37

*Primary Examiner*—Clifford D. Crowder
*Assistant Examiner*—Bibhu Mohanty

[57] ABSTRACT

A portable device to aid in the folding of shirts or similar articles of clothing comprising a horizontal support structure, a vertically extending support part, and a horizontal carriage projecting forwardly from the support part in substantial horizontal spaced relationship above the support structure. The carriage is shiftable in a vertical direction to allow for stacks of garments of varying heights, and to simplify and expedite the process of folding.

2 Claims, 4 Drawing Sheets

GARMENT FOLDING AID

The invention relates to a garment folding mechanism, specifically to a machine designed to improve consistency and to both expedite and simplify the process of folding garments.

BACKGROUND OF THE INVENTION

In the garment industry, when several garments are to be folded, they are either bulk folded or folded individually. Bulk folding involves folding more than one garment at a time. Although this method is fast and can be accomplished quickly by hand alone, individually folded garments are preferred because they are easy to organize and more attractive. In some cases, as in point of sale displays, individually folded garments are the standard. The individual folding of garments is usually administered in the following ways: a) with the use of fully or semi-automatic machines; b) with the aid of small folding boards; c) with the aid of small apparatuses; d) or by hand alone.

a) Fully and semi-automatic folding machines are available and efficient, but they are too costly for individuals and small to medium size businesses. As a result, most businesses (as well as individuals in the home environment) must resort to folding garments in more inexpensive manners, as will be described in the following.

b) The use of folding boards, which is familiar to those skilled in the art, has an advantage over other folding methods in that it provides an inexpensive way of achieving a higher level of consistency; that is to say, garments folded with the use of a folding board are roughly equivalent in size and shape. When using a folding board, the operator lays the shirt face down on a folding table and then places a small rigid or semi-rigid board on the top portion of the garment. The size of the board is roughly equivalent to the length and the width of the folded garment. The sides of the board are used as fold guides for the longitudinal folds and the bottom of the board is used as a guide for the latitudinal fold. After these folds are administered, the board is removed from within the folded garment. Although this method may offer a slight improvement in consistency, it is tedious—the operator must realign the board to each individual garment. Aligning the board to the same location on each garment is time consuming, and any slight misalignment affects the shape of the folded garment.

c) Mechanical devices also have been developed to ease the process of folding. While these apparatuses may slightly increase consistency, they do not satisfy the primary requirement of speed (this will be further discussed in the following prior art section).

d) The shortcomings associated with the previously listed methods cause many folding operations to resort to hand folding. Although an operator needs no more than a folding surface, hand folding is relatively slow, tedious, and the size of the folded garments is usually inconsistent.

PRIOR ART

The small apparatuses that have been patented can be grouped into two major categories: a) apparatuses with folding guides that move in a horizontal direction and b) apparatuses with folding guides that pivot on an axis behind the folding area.

a) U.S. Pat. No. 740,458 to Joseph McKay and George Wenzell on 6 Oct. 1903 for a Garment-Folding Apparatus discloses a guide that moves in a horizontal direction. Each shirt must be aligned to the apparatus individually, therefore the operation is relatively slow when folding multiple garments. While this machine may be an improvement over the use of folding boards, it does not greatly speed the process of folding.

b) U.S. Pat. No. 2,010,333 to James Steele on 6 Aug. 1935 for Shirt Folding Board and U.S. Pat. No. 2,632,564 to Samuel Bloom on 7 May 1951 for Shirt Package and Method of Packaging both disclose folding guides that pivot on a horizontal axis behind the folding area. The guide is parallel to the folding surface at one point along its travel and thus only one garment can be aligned to the apparatus at a time. The same pivot arrangement, and the problems associated with it, can be found in smaller and simpler devices such as the one illustrated in U.S. Pat. No. 2,988,251 to Helen Ziegler on 13 Jun. 1961. Although they are different, the aforementioned devices require each garment to be treated individually throughout the folding process.

The shortcomings associated with the above noted mechanical devices lead to one common result: those who need and can afford them use automatic machines, while those who cannot resort to folding with the aid of a board or folding by hand alone. Both board and hand folding, however, leave the entire operation solely to the judgment of the operator; this causes these methods to share many of the problems with the above noted devices.

OBJECTS AND FEATURES

The several objects and features of this invention are to provide a garment folding aid that serves:

(a) to minimize the range of motion for the operator. All but a few of the motions required for folding with this invention occur directly in front of the operator at a comfortable level just above the folding table. The minimal range of motion results in increased ease, efficiency, and speed.

(b) to adjust to a stack of garments. The garments within the stack may vary in terms of size or type. The ability of this invention to adjust to varying heights simplifies the set up procedure, that is to say, instead of each garment being lined up to the machine individually, they are quickly lined up to each other and subsequently lined up to the machine as a group.

(c) to allow a consistent fold down the entire length of the garment. The vertical movement of the folding guide allows the entire length of the garment to enjoy the aid of the folding guide as opposed to only a portion thereof as is common in the prior art. A slight lift of the guide allows the garment to be slid along the guide. Because of this lift and slide, the longitudinal fold can be made along the entire length of the guide (which is as long or nearly as long as the garment itself). The benefit of this lies in the fact that the longitudinal folds can be made quickly and without caution; the sides of the garment can simply be thrown atop the folding guide. This adds to the speed, consistency, and ease.

(d) to allow for different folding patterns. Once the longitudinal folds have been made, this invention allows the operator to choose between several different folding patterns. The latitudinal folds can be made in varying locations or the garment may be rolled into a compact cylinder.

(e) to provide ease in bagging. After the garment is folded or rolled, the rigid folding guide facilitates a situation in which the operator can easily slide a bag over the garment and guide and then remove both the garment and bag from the guide.

(f) to provide a folding method which facilitates a simple means of including a cardboard insert into the folded garment.

(g) to provide portability. Many folding situations occur in small spaces or in multiple locations and therefore portability of a folding aid is beneficial. This invention is compact, and moreover the folding guide is easily bent back to conserve table space during times of non-use.

(h) to have the ability to easily replace the folding guide. An easily replaceable folding guide allows the operator to have more than one width of folding guide which allows gross differences in garment size to be accommodated to.

(i) to provide an affordable folding aid. The primary components of this invention are readily available which makes it easy to manufacture and renders it affordable.

(j) to provide a folding method that does not require a high level of skill. An operator can learn to use the aid very quickly.

The foregoing and other objects and features of my invention will become apparent and fully understood from the following detailed description of one preferred form of the invention throughout which references are made to the accompanying drawings.

DRAWING FIGURES

Figure 9:
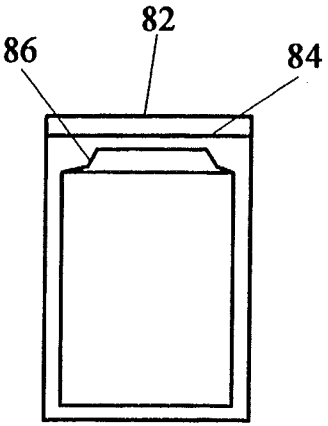

FIGS. 3 to 8 display the process sequence; and,

FIG. 9 is a view of a folded and packed garment.

REFERENCE NUMERALS IN DRAWINGS

Figure 1:
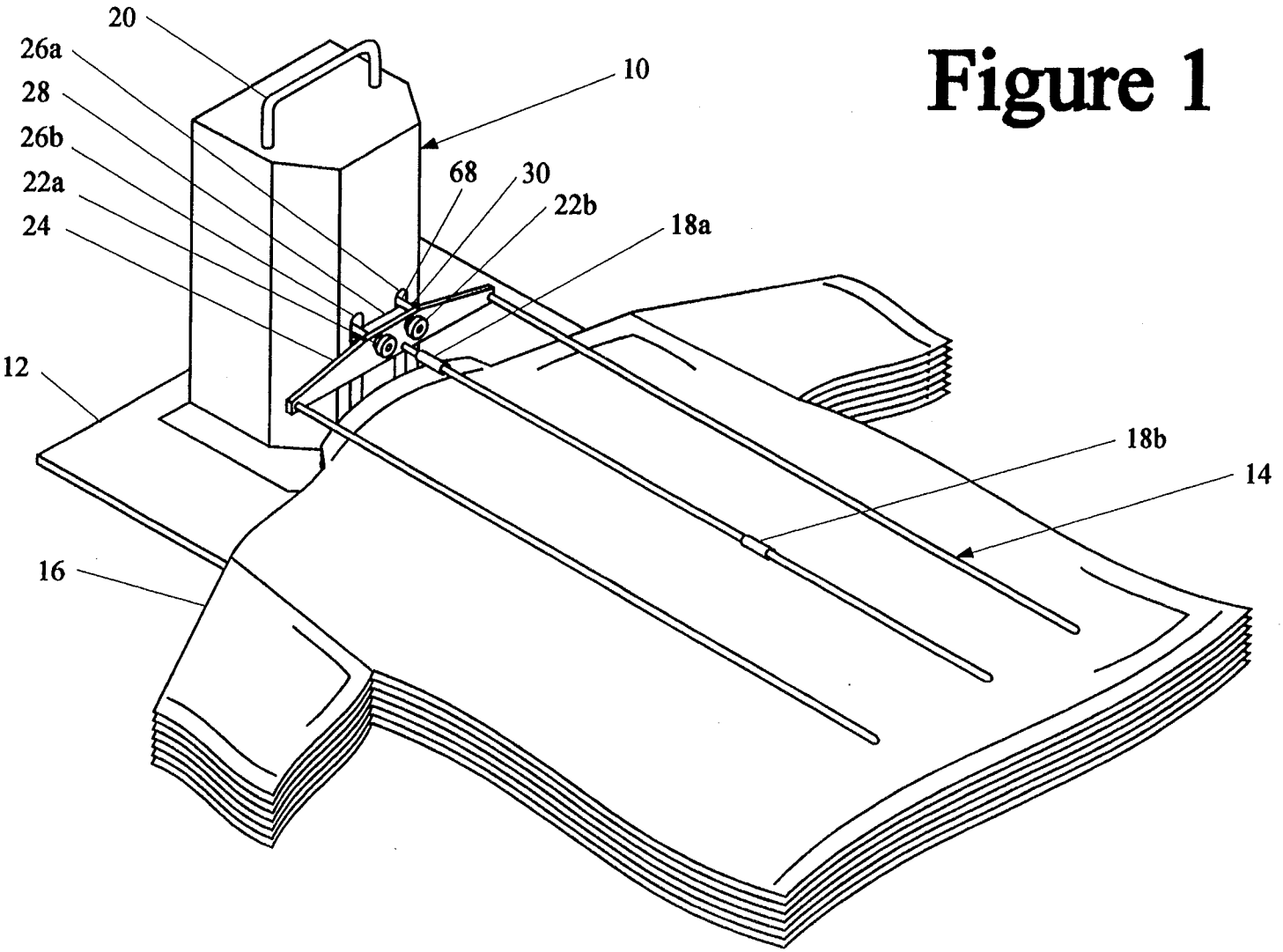
FIG. 1 is an isometric view of an embodiment of the invention.
Figure 2:
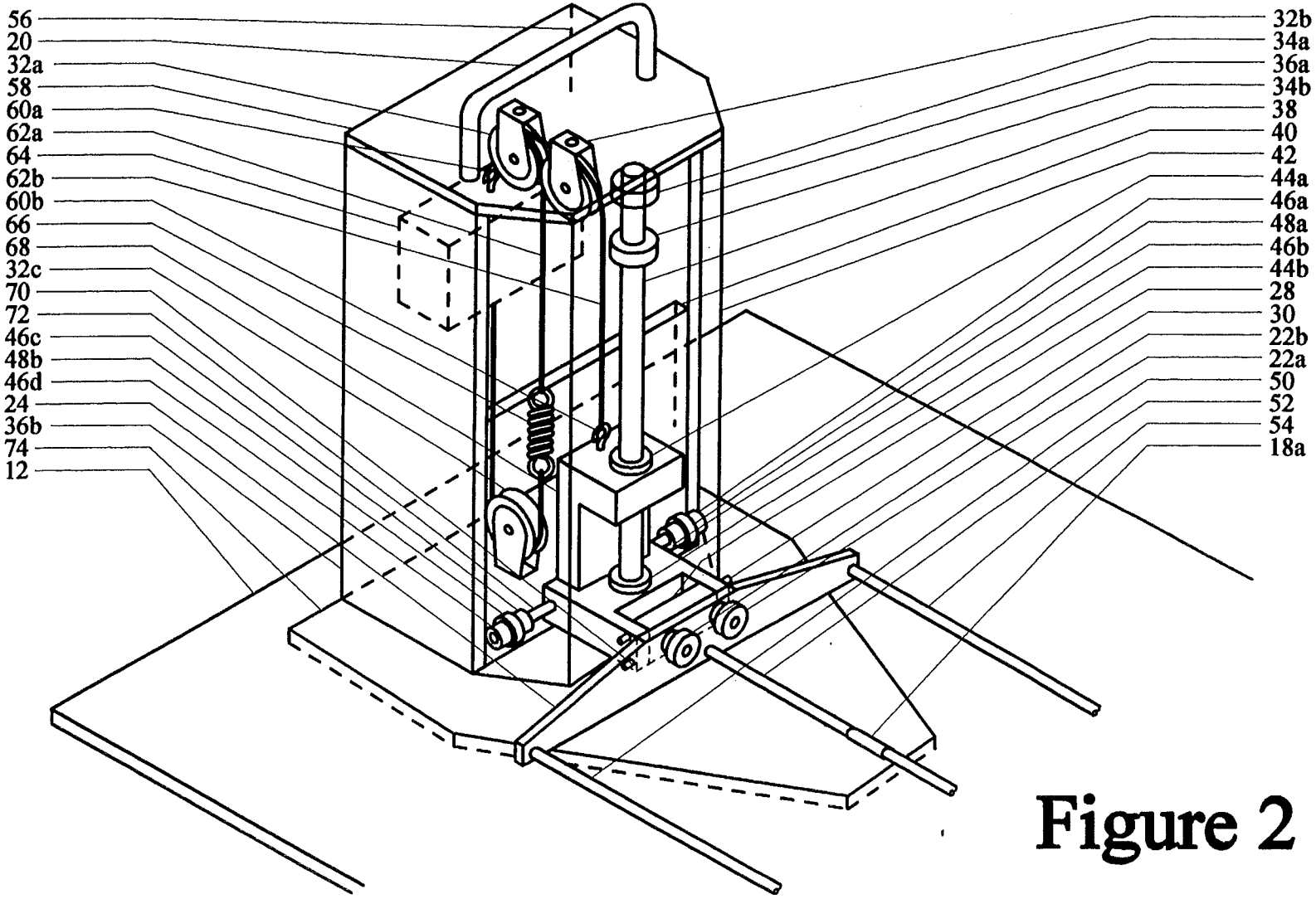
FIG. 2 is an enlarged view of a portion of FIG. 1 with parts shown in dotted lines to better illustrate details of the invention.
Figure 3:
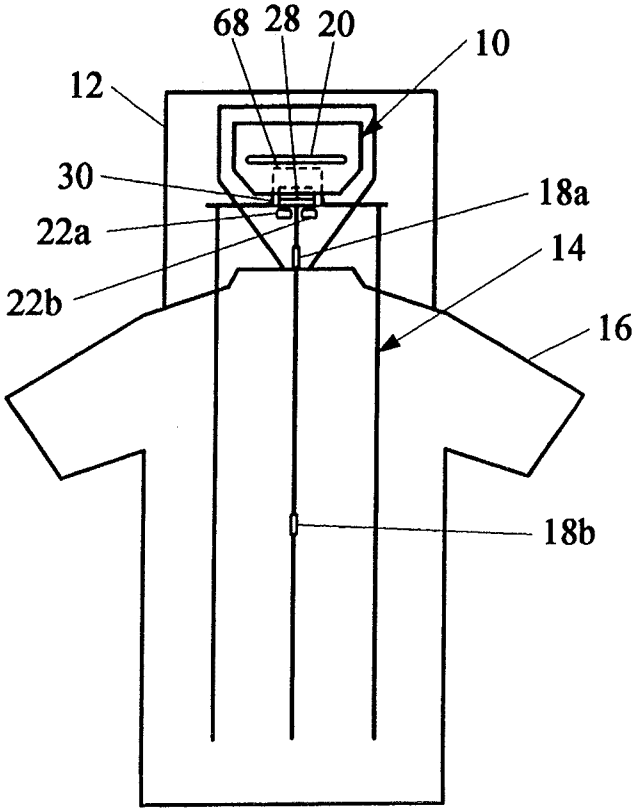
Figure 4:
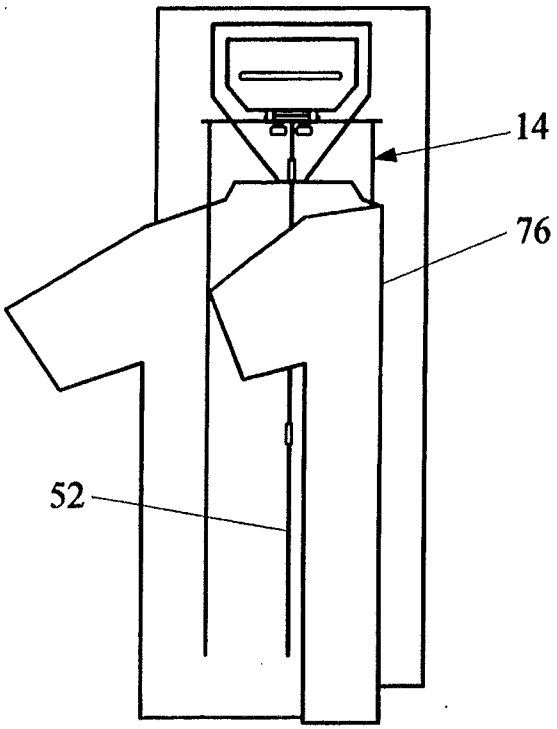
Figure 5:
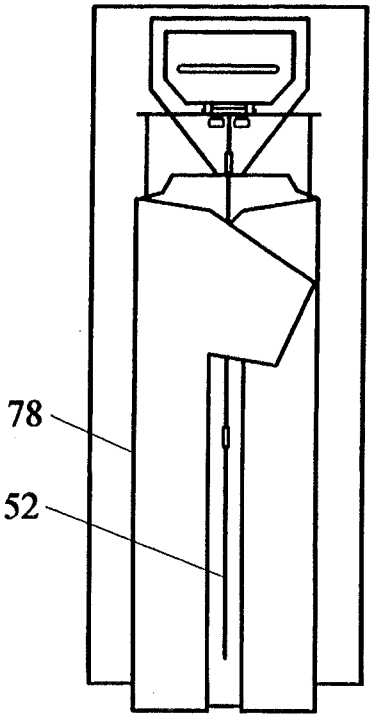
Figure 6:
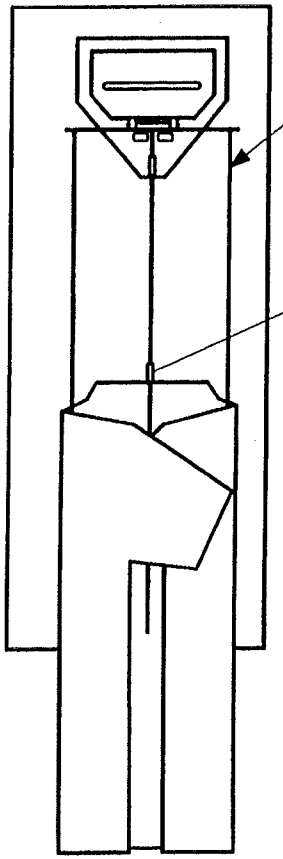
Figure 7:
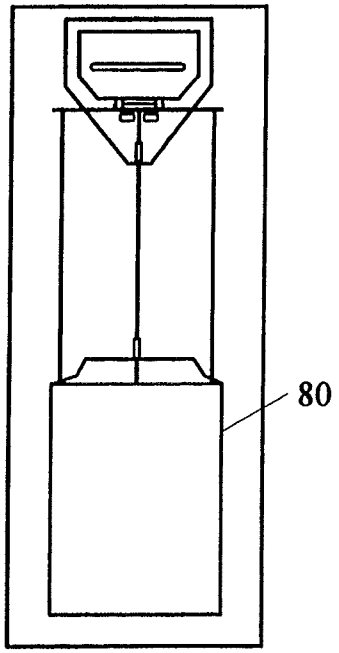
Figure 8:
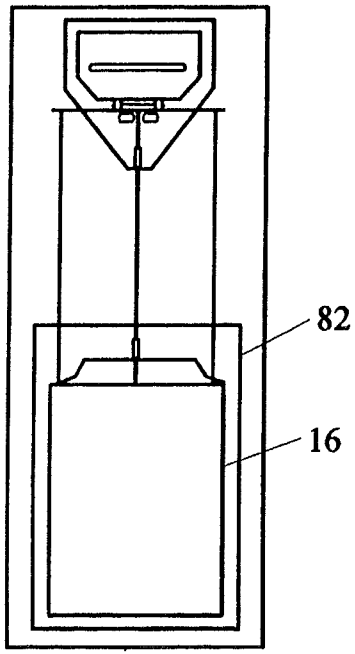

| | | | |
|---|---|---|---|
| | | FIG. 1 | |
| 10 | main unit | 12 | folding base |
| 14 | folding guide | 16 | stack of garments |
| 18 a,b | adjustable marker | 20 | handle |
| 22 a,b | finger nut | 24 | crossbar |
| 26 a,b | hole in enclosure | 28 | swivel |
| 30 | dowel pin | | |
| | | FIG. 2 | |
| 12 | folding base | 20 | handle |
| 22 a,b | finger nut | 24 | crossbar |
| 32 a–c | pulley | 34 a,b | vertical rod shaft collar |
| 36 a,b | side plate | 38 | vertical rod |
| 40 | internal plate | 42 | enclosure |
| 44 a,b | linear bearings | 46 a–d | horizontal rod shaft collar |
| 48 a,b | bearing | 50 | left rod |
| 52 | center rod | 54 | right rod |
| 56 | back plate | 58 | top plate |
| 60 a,b | eyelet | 62 a,b | cable |
| 64 | counterbalance | 66 | extension spring |
| 68 | linear bearing housing | 70 | spring plunger |
| 72 | horizontal rod | 74 | base plate |
| | | FIGS. 3–8 | |
| 10 | main unit | 12 | folding base |
| 14 | folding guide | 16 | garment(s) |
| 18 a,b | adjustable marker | 20 | handle |
| 22 a,b | finger nuts | 28 | swivel |

-continued

REFERENCE NUMERALS IN DRAWINGS

| | | | |
|---|---|---|---|
| 30 | dowel pin | 52 | center rod |
| 68 | linear bearing housing | 76 | right side of garment |
| 78 | left side of garment | 80 | bottom of garment |
| 82 | bag | | |
| | | FIG. 9 | |
| 82 | bag | 84 | seal |
| 86 | folded garment | | |

DESCRIPTION

A comprehensive view of the preferred embodiment of the garment folding aid is illustrated in FIG. 1. The garment folding aid is composed of three main parts; a main unit (10), a folding base (12), and a folding guide (14). Main unit (10) is composed of a housing, a vertically extending support part and a positioning means that a) allows for the vertical movement of guide (14); b) allows guide (14) to be stopped at more than one point along its path of movement; and c) assures that guide (14) is parallel with folding base (12) at the moment that the folds are to be administered. Folding base (12) is placed atop a support surface such as a table and together they define a horizontal support structure. Positioning means that might be advantageously used include ratchet systems, magnetic systems, counterbalance systems, motor driven systems and the like. A counterbalance system, here disclosed, is the preferred system because it simple in design and inexpensive to manufacture. It allows the operator to easily and manually select a multitude of positions along the vertical axis.

Folding base (12) is preferably made of a material that has a high coefficient of friction so that garments supported thereon are not subject to becoming easily displaced. The material is preferably flexible so that it can be conveniently rolled up or folded into a compact shape when the device is not in use. A mounting or linear bearing housing (68) is connected to a swivel (28) with a dowel pin (30). Swivel (28) is connected to a crossbar (24) with the use of finger nuts (*22a, 22b*) which allow for both the easy removal and the easy reattachment of guide (14). Dowel pin (30) acts as the pivotal support of guide (14); at any point of the stroke of guide (14), the operator can bend it back to pivot around dowel pin (30). In pivoting guide (14) upward, the operator frees room for aligning a stack of garments. Guide (14) can also be bent back after the folding session to keep the table top clear for other purposes. Crossbar (24) is affixed to three rods or elongate beams (50, 52, 54). A central rod (52) includes one or more adjustable markers (*18a, 18b*) to aid in the folding process. Adjustable markers (*18a, 18b*) can be made from short lengths of colored plastic tubing. A handle (20) is fixed to the top of main unit (10) to ease portability. A garment or stack of garments (16) is placed face down between the guide (14) and folding base (12) and in this location they are prepared for the folding procedure.

FIG. 2 displays the components of the garment folding aid. The components of main unit (10) are preferably made of some type of rigid and durable material. The frame protects the components of main unit (10) to assure reliable operation; it is comprised of a base plate (74), two side plates (*36a, 36b*), a top plate (58), a back plate (56), and an enclosure (42). Base plate (74) is connected to side plates (*36a, 36b*) and to back plate (56).

Base plate (74) should be relatively wide and long to assure stability. Side plates (36*a*, 36*b*) are connected to top plate (58) as well as to enclosure (42). A vertical rod (38) extends from top plate (58) to base plate (74) and is placed in a bore in each plate. Vertical rod (38) is secured in place with shaft collars (34*a*). In this embodiment, vertical rod (38) acts as the support part.

A shaft collar (34*b*) is attached around vertical rod (38) to act as a stop for bearing housing (68) along its path of vertical movement. Bearing housing (68) is preferably made out of a single piece of metal to assure rigidity. Two holes in bearing housing (68) house two linear bearings (44*a*, 44*b*) which allow for low friction movement. A horizontal rod assembly is attached to carriage (68) to prevent rotational movement. The assembly consists of a horizontal rod (72) and bearings (48*a*, 48*b*) which are fixed in place with shaft collars (46*a*, 46*b*, 46*c*, 46*d*). Bearings (48*a*, 48*b*) are located on horizontal rod (72) on both sides of bearing housing (68). Bearings (48*a*, 48*b*) roll up and down along an internal plate (40). Internal plate (40) is attached to side plates (36*a*, 36*b*) and to base plate (74). Internal plate (40) extends from base plate (74) to the point of maximum height of the movement of the horizontal rod assembly.

Bearing housing (68) and the parts of folding guide (14) define a horizontal carriage. Crossbar (24) is attached to bearing housing (68) with finger nuts (22*a*, 22*b*). Guide (14) consists of three rods or beams, a left rod (50), a central rod (52), and a right rod (54). The distance between the outer edges of left rod (50) and right rod (54) is equivalent to the desired width of folded garments.

The primary parts of the preferred positioning means or counterbalance system involve the use of pulleys (32*a*–32*c*), cables (62*a*, 62*b*), and a counterbalance (64). An eyelet (60*b*) is attached to bearing housing (68) at a point directly behind vertical rod (38). A cable (62*b*) is tied around the eyelet (60*b*). Cable (62*b*) extends up to one pulley (32*a*), around another pulley (32*b*), and attached to an eyelet (60*a*). This eyelet (60*a*) is attached to counterbalance (64). Two plastic stops (not shown), or other means for low friction may be attached to both sides of the back of the counterbalance to travel up and down along back plate (56) to prevent the counterbalance from rotating within main unit (10). Cable (62*a*) continues in a loop around pulley (32*c*) to an extension spring (66). Spring (66) provides tension to the cables to assure proper functioning of the counterbalance system.

FIGS. 3 to 8 display the top view of the folding procedure, each successive figure represents a step in the process. The operator lifts guide (14) to the top of its stroke, this occurs when the top of bearing housing (68) hits shaft collar (34*b*) (see FIG. 2). The operator continues to lift the end of guide (14) and this forces the nose of spring plunger (70) out of a groove in swivel (28) which allows guide (14) to be pivoted around dowel pin (30). One to several garments (16) are lined up to each other creating a stack which is placed face down on top of folding base (12). Guide (14) is subsequently pivoted down which allows spring plunger (70) to snap back into groove. Most manufacturers of garments provide a longitudinal centerline fold down the back and front of a garment. This line is aligned directly below the center rod of guide (14). If this folded line is not provided, the operator simply aligns the tag of the garment with the center rod of the folding guide. Guide (14) is then lowered to the level of the top garment (16).

A right side of garment to be folded (76) is folded over the guide. If folding a long sleeved garment, the operator first makes the longitudinal fold and then folds the sleeve down parallel with, and on top of center rod (52).

A left side of garment to be folded (78) is folded over the guide. If folding a long sleeved garment, the operator first makes the longitudinal fold and then folds the sleeve down parallel with, and on top of center rod (52).

Guide (14) and the garment being folding is raised slightly and the garment is pulled toward the operator until the top of the garment reaches the near end of marker (18*b*). Optional: A piece of cardboard or other rigid board may be placed on top of the garment at this time. The cardboard within the folded garment provides rigidity which yields ease of handling after the garment is folded.

A bottom portion of garment (80) is folded up once or twice (depending on desired end product size) against the ends of guide (14). It may also be rolled up to create a compact end product.

A bag (82) may be fitted over entire garment and guide.

The garment (and bag and/or cardboard if used) is slid off guide (14). (If a bag is used, it may be sealed with a heat seal (84) with the aid of an impulse sealer or similar item). This yields a completed product (86).

SUMMARY, RAMIFICATIONS, AND SCOPE

It is evident from the information explained heretofore, that the Garment Folding Aid provides an affordable means of folding garments more expediently as well as more consistently than currently available methods. While the above description contains many specificities, they should not be construed as limitations on the scope of my invention, but rather as an exemplification of one preferred embodiment thereof. Many other variations are possible such as the use of different materials, and different means of providing a vertical motion system as described in the description section of this application. Accordingly, the scope of the invention should be determined not by the embodiment illustrated, but by the following claims.

I claim:

1. A garment folding device including: a folding base dimensioned to the size of a garment to be folded, a folding guide, a main unit for lifting the folding guide, the folding guide including a crossbar supporting three parallel elongate support rods on which the garment is to be folded, the main unit enclosing a vertical support rod and a linear bearing slidably movable on said support rod, said crossbar connected to said linear bearing, the main unit further enclosing a counterbalance weight and a cable connected between the weight and the linear bearing for providing a force to lift the fold guide, at least one pulley over which the cable rides, a set of bearings connected to the linear bearing and a vertical plate, the set of bearings being in rolling contact with the vertical plate.

2. The garment folding device claimed in claim 1 further including an adjustable marker on one of the support rods.

* * * * *